US005961224A

United States Patent [19]

Baitz et al.

[11] Patent Number: 5,961,224

[45] Date of Patent: Oct. 5, 1999

[54] DOCUMENT TRANSPORT AND STOP DEVICE

[75] Inventors: Günter Baitz; Wolfgang Malke, both of Berlin, Germany

[73] Assignee: Siemens Nixdorf Informationssysteme A, aderborn, Germany

[21] Appl. No.: 09/142,199

[22] PCT Filed: Mar. 3, 1997

[86] PCT No.: PCT/DE97/00385

§ 371 Date: Sep. 2, 1998

§ 102(e) Date: Sep. 2, 1998

[87] PCT Pub. No.: WO97/33756

PCT Pub. Date: Sep. 18, 1997

[30] Foreign Application Priority Data

Mar. 12, 1996 [DE] Germany ..... 196 09 659

[51] Int. Cl.[6] ..... B41J 11/20

[52] U.S. Cl. ..... 400/56; 400/59; 400/630; 400/161; 400/637

[58] Field of Search ..... 400/55, 56, 59, 400/637.6, 637, 637.1, 630, 631, 632, 632.1, 645, 645.1, 161–163; 271/245, 246

[56] References Cited

U.S. PATENT DOCUMENTS

| | | | |
|---|---|---|---|
| 4,563,692 | 1/1986 | Negita et al. | 347/197 |
| 4,620,807 | 11/1986 | Polit | 400/56 |
| 5,078,522 | 1/1992 | Nishizawa et al. | 400/583.3 |
| 5,172,987 | 12/1992 | Stellmach et al. | 400/86 |
| 5,214,750 | 5/1993 | Minowa et al. | 395/111 |
| 5,873,664 | 2/1999 | Umemo | 400/579 |

FOREIGN PATENT DOCUMENTS

| | | |
|---|---|---|
| 0 281 499 A2 | 1/1988 | European Pat. Off. . |
| 31 44 388 A1 | 11/1981 | Germany . |
| 34 11 685 A1 | 3/1984 | Germany . |
| 39 34 126 | 10/1989 | Germany . |
| 42 28 765 A1 | 8/1992 | Germany . |

*Primary Examiner*—Edgar Burr
*Assistant Examiner*—Dave A. Ghatt
*Attorney, Agent, or Firm*—Hill & Simpson

[57] ABSTRACT

By moving the printing head of a printing unit to a position outside the printing area, a paper stop is pivoted into the paper transport path and, by lowering the printing head, a gap is opened both between the printing head and printing abutment and between the paper pressure rollers, the coupling of the printing head to the paper pressure rollers in relation to the lowering movement simultaneously effecting adjustment of the printing head gap.

17 Claims, 1 Drawing Sheet

DOCUMENT TRANSPORT AND STOP DEVICE

The invention relates to paper transport in printing devices having a movable printing head.

BACKGROUND OF THE INVENTION

In printers for individual sheets or documents, a reference position for the document must be determined; a paper stop that can be pivoted into the printing path being used for this. Furthermore, a gap between the paper transport rollers has to be opened during insertion. This has previously been achieved by a respectively associated and dedicated drive, for example by lifting magnets.

The object of the invention is to provide the said functions without a dedicated drive.

SUMMARY OF THE INVENTION

The invention achieves this object by the printing head moving into a position outside the printing area and in so doing actuating a lever which causes the paper stop to pivot into the paper transport path. Furthermore, the printing head runs onto a stationary mating piece, so that it is pressed away from the printing abutment and a gap is opened, into which the material to be printed can be moved. At the same time, by means of angled levers and push rods, the pairs of paper transport rollers are opened. The arrangement additionally effects adjustment of the printing head gap.

This is therefore an arrangement in which, by moving the printing head of a printing unit to a position outside the printing area, both a paper stop is pivoted into the paper transport path and, as a result of lowering the printing head, a gap is opened both between printing head and printing abutment and between the paper pressure rollers, the coupling of the printing head to the paper pressure rollers in relation to the lowering movement simultaneously enabling adjustment of the printing head gap.

In an embodiment, the present invention provides a printing device for transporting a piece of paper in a transport direction and along a predetermined transport path that defines a plane. The printing device of the present invention comprises a printing head connected to a first lever. The first lever and the printing head are connected to a first stationary bearing for pivotal movement about a first stationary bearing. The first stationary bearing has a first axis that is parallel to the plane of the transport path and perpendicular to the transport direction. The first lever is connected to a guide roller by a second bearing having a second axis that is parallel to the first axis. The first lever is also connected to a third bearing. The third bearing is disposed between the first stationary bearing and second bearing. The third bearing has a third axis that is parallel to the first and second axes whereby movement of the guide roller in a direction perpendicular to the plane of the transport path results in movement of the printing head in the direction perpendicular to the plane transport path but to a lesser degree. The printing head also is mounted on a guide rod that extends perpendicular to the transport path and enables the printing head to be moved or slid along the guide rod in a lateral direction away from the transport path.

In an embodiment, the printing device further comprises a second lever connected to the printing head and to the first, second and third bearings on an opposing side of the printing head and on an opposing side of the transport path.

In an embodiment, the third bearing comprises a guide rod that extends through the printing head.

In an embodiment, the printing head is mounted on the guide rod so that it can rotate about the third axis and the guide rod, which is fixedly connected to the first and second levers.

In an embodiment, the printing head of the invention further comprises a third lever connected to a second guide roller by a fourth bearing having a fourth axis that is parallel to the first axis. The first and second levers are connected by a push rod.

In an embodiment, the printing device of the present invention further comprises a paper stop pivotally connected to the third lever at a fifth bearing. The paper stop also engages a pivoting lever which is mounted to a sixth axis and which further engages an actuation roller. The printing head engages the actuation roller which imparts movement to the pivoting lever which, in turn, imparts movement to the paper stop when the printing head is moved laterally away from the transport path. As a result, when the printing head is moved laterally away from the transport path, at least a portion of the paper stop is moved into the transport path.

In an embodiment, the present invention comprises a printing device for transporting a piece of paper in a transport direction along a predetermined transport path that defines a plane. The printing device comprises a printing head disposed parallel to the transport path. The printing head is mounted to a guide rod that extends perpendicular to the transport path. The printing head is movable along the guide rod in a lateral direction away from the transport path. The printing head engages a pivoting lever when the printing head is moved along the guide rod and laterally away from the transport path. The pivoting lever thereafter engages a paper stop when the printing head is moved laterally away from the transport path which results in movement of at least a portion of the paper stop into the transport path.

In an embodiment, the paper stop comprises a stop lever having a stop surface. The paper stop lever is rotated about an axis that is parallel to the plane of the transport path and perpendicular to the transport direction. The pivoting lever has an axis of rotation that is disposed perpendicular to the transport path. The axis of rotation of the pivoting lever divides the pivoting lever into a long section which engages the paper stop and a short section which is moved as a result of the lateral movement of the printing head away from the transport path.

In an embodiment, the printing head engages an actuation roller disposed between the printing head and the pivoting lever. The actuation roller engages the short section of the pivoting lever and imparts pivotal movement to the pivoting lever when the printing head is moved laterally away from the transport path.

Other objects and advantages of the present invention will become apparent from reading the following detailed description and appended claims, and upon reference to the accompanying drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
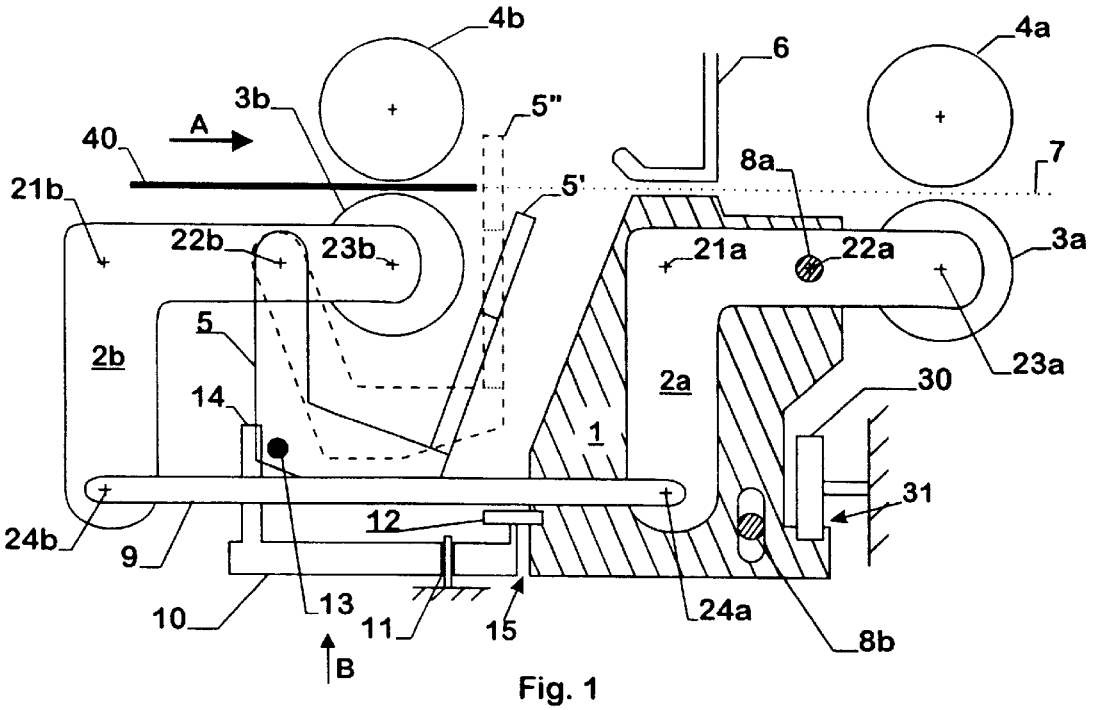
FIG. 1 is a cross sectional view through a printing head, paper transport and paper stop assembly made in accordance with the present invention.

FIG. 1 shows a cross section through an arrangement according to the invention. In this case, a printing head that is mounted on a printing-head carrier is used. In order to simplify the description, the term printing head is used below synonymously with printing-head carrier. The printing head 1 is arranged on guide rods 8*a*, 8*b* so that it can be displaced perpendicular to the plane of the illustration, and is provided with a drive (not illustrated) for a movement in this direction. Opposite the printing head 1 there is a printing abutment 6, so that there is a paper transport path 7, in which the document 40 to be printed is guided by guiding and supporting plates (not shown). The guide rods 8*a*, 8*b* are connected to the chassis in such a way that the printing head 1 can be moved away from the paper transport path 7 by a few millimeters in the plane of the illustration, and thus the distance of the printing head 1 from the printing abutment 6 can be altered, as is described further below.

The document 40 to be printed is shown in an initial position. Upstream of the printing head, it is transported in the direction of the arrow A by a guide roller 3*b*, which presses the document against a mating roller 4*b*. Located further in the transport direction are a second guide roller 3*a* and an associated mating roller 4*a*, which undertake the transport when the document has been gripped by them. The mating rollers 4*a*, 4*b* are firmly connected to the chassis via rotary bearings and are driven synchronously by means that are not shown. The guide rollers 3*a* and 3*b* are fastened via rotary bearings 23*a*, 23*b* to angled levers 2*a* and 2*b*. In this case, it is also possible to use, in a known way, pairs of angled levers which, by means of rods that are perpendicular to the plane of the figure, are mechanically rigidly coupled to each other. In this case, one lever each is preferably used to the right and left of the paper transport path, and are connected by a rod on which guide rollers 3*a* are rotatably mounted. For their part, the angled levers 2*a*, 2*b* are held with respect to the chassis via rotary bearings 21*a*, 21*b*. A push rod 9 couples the angled levers via further rotary bearings 24*a*, 24*b*, so that the guide rollers 3*a*, 3*b* can be pressed to the same extent against the mating rollers 4*a*, 4*b* or can be lifted off the mating rollers. All the axes of the bearings 21*a*, 21*b*, 22*a*, 22*b*, 23*a*, 23*b* are parallel to one another.

Furthermore, there is a paper stop 5, which preferably has a stop surface 5' perpendicular to the plane of the figure. The paper stop 5 is designed as a lever, which is fastened via a rotary bearing 22*b* approximately in the middle between the stationary rotary bearing 21*b* and the bearing point 23*b* for the guide roller 3*b*. Measures that are not shown, for example a suitable bearing or a double lever, are used to prevent the paper stop deviating from the plane shown.

Fitted to the paper stop 5, at some distance from the pivot 22*b*, is a bolt 13 that projects perpendicular to the plane of the illustration. This bolt can be actuated in the same direction A as the paper transport by means of a driver 14 of a pivoting lever 10, with the result that the paper stop 5 rotates in the plane of the illustration and can be moved into the position 5" illustrated by dashed lines.

Figure 2:
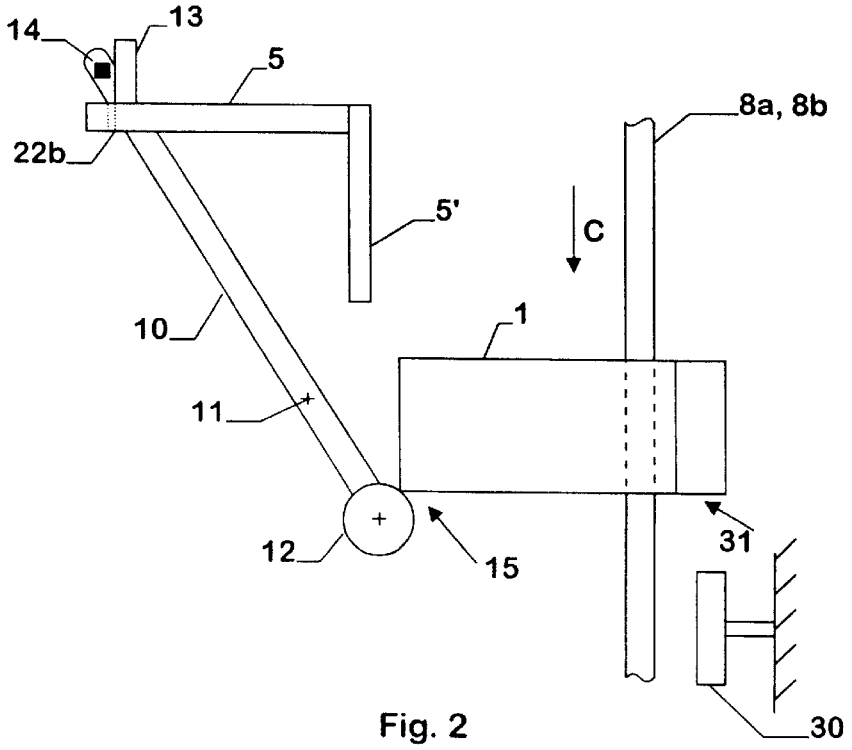
FIG. 2 is a partial bottom plan view of the embodiment shown in FIG. 1.

The pivoting lever 10 is movably supported by means of a rotary bearing 11, whose axis is perpendicular to the paper transport path 7. In FIG. 2, the pivoting lever 10 is illustrated from the view of arrow B. The printing head 1 is moved in the direction C on the guide rods 8*a*, 8*b* by the drive (not shown). In this case, the position shown and, at the same time, the initial position of the printing head are located at the left-hand printing edge. By being moved further in the direction opposite to the arrow C and laterally away from the printing area, the edge 15 actuates a roller 12, as a result of which the pivoting lever 10 actuates the bolt 13 by way of the driver 14, with the result that the paper stop 5' is pivoted into the operating position 5". Since, as illustrated in FIG. 2, the pivoting lever 9 has a short lever arm on the roller 12 and a long lever arm on the driver 14, a short travel of a few millimeters printing-head displacement is sufficient to bring the paper stop 5 into the operating position 5". At the same time, the long lever makes it possible to bring the paper stop 5 into the printing area, although the printing head 1 carries out a triggering movement outside the printing area.

A further movement of the printing head 1 in the direction C does not lead to any change in the position illustrated by 5" in relation to the pivoting lever 10 and hence the paper stop 5, 5', since the roller 12 now rests on the surface that adjoins the edge 15. A second roller 30 is fitted in a stationary manner in relation to the chassis and therefore, given a continuation of the movement of the printing head 1, presses the printing head downward away from the paper transport path 7 via a run-on incline 31. It thus effects the lowering of the printing head. The printing head 1 is connected in a bearing 22*a* to the angled lever 2*a*, so that the latter rotates around the fixed bearing 21*a*, and the guide roller 3*a* is lifted off the paper transport path 7. This is achieved, for example, by a guide rod 8*a* and two angled levers 2*a* to the right and left of the paper transport path 7 being used, in which, at the location of the bearing 22*a*, the guide rod 8*a* is connected to the angled lever 2*a*. This connection may be made in a permanent manner, since in the case of a round guide rod 8*a* (or a suitable mounting of the guide rod 8*a* in the printing head), the printing head 1 can execute a rotary movement about the axis of the guide rod. The second guide rod 8*b*, which prevents a tilting movement of the printing head, is connected to the chassis via a similar lever pair or, as indicated in FIG. 1, the printing head can be displaced by means of a slot. The push rod 9 forces the second angled lever 2*b* to carry out an identical movement, so that the second guide roller 3*b* is also lifted. In this way, the feed for a document 40 to be printed is opened, it being possible for said document to be guided on a supporting table (not shown) and pushed by the user as far as the paper stop 5". it has been detected, for example by means of a light barrier, that the document has been inserted, the printing head 1 carries out a movement in the direction opposite to the arrow C, that is to say toward the initial position and toward the printing positions. By this means, firstly the lowering of the printing head is cancelled, so that the printing head 1 moves against the printing abutment 6 again and the guide rollers 3*a*, 3*b* move against the mating rollers 4*a*, 4*b*. A spring (not shown) forces this movement and ensures that the guide rollers 3*a*, 3*b* press against the mating rollers 4*a*, 4*b*. The further return movement of the printing head 1 also releases the pivoting lever 10, which then moves back as a result of the force of gravity or a further spring (not shown) acting on the paper stop 5, and leads to the paper stop 5 being pivoted out of the paper transport path 7. Driving the mating rollers 4*a*, 4*b* or else the guide rollers 3*a*, 3*b* now makes it possible for the document to be printed to be moved between printing head 1 and printing abutment 6 and printed there.

Adjustment of the printing gap is simultaneously effected by the angled levers 2*a*, 2*b*. Since the document 40, as a result of its thickness, presses the guide roller 3*a* or 3*b* away from the mating roller 4*a* or 4*b*, this movement is transmitted via the bearing 22*a* to a smaller extent to the printing head 1, so that in the case of a thicker document 40, a greater gap is produced between printing head 1 and printing abutment 6. In this case, a transmission ratio of 2:1 has proved to be satisfactory, in that the bearing axis 22*a* connecting the printing head 1 to the angled lever 2*a* is located approximately in the middle between the fixed bearing 21*a* and the bearing 23*a* for the guide rollers 3*a*, 3*b*.

Since the paper stop 5 is supported approximately in the middle of the horizontal leg of the angled lever 2*a*, the same moldings can be used for the angled levers 2*a* and 2*b*, which constitutes a simplification in production.

The preferred embodiment illustrated can also be used in simplified form, by the angled lever 2*b* in the region of the paper stop 5 and the push rod 9 being dispensed with, and the mating roller 3*b* being pressed permanently against the drive roller 4*b* by springing. This leaves the lowering of the printing head by the roller 30 and the gap adjustment by the angled lever 2*a* in the region of the printing head 1, in cooperation with the drive rollers 4*a* there, mating rollers 3*b* and the angled lever 2*a*. In the case of this solution, the springing for the roller pair 3*b*, 4*b*is less powerful than that for the roller pair 3*a*, 4*a* that is coupled to the printing head. If a sufficiently stiff document is inserted, then it can be pushed as far as the stop, pressing the rollers apart, and after the stop rule has been lowered, said document can be transported as far as the other roller pair, coupled to the printing head, which then determines the transport.

The rollers 12 and 30 can also be replaced by appropriately configured and lubricated sliding surfaces, if the printing-head drive is appropriately designed.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

We claim:

1. A printing device for transporting a piece of paper in a transport direction and along a predetermined transport path that defines a plane, the printing device comprising:

a printing head, a first lever, a first stationary bearing, a guide roller, a second bearing, a third bearing and a first guide rod, the printing head connected to the first lever, the first lever and printing head being connected to the first stationary bearing for pivotal movement about the first stationary bearing, the first stationary bearing having a first axis that is parallel to the plane of the transport path and perpendicular to the transport direction, the first lever also being connected to the guide roller by the second bearing having a second axis that is parallel to the first axis, the first lever further being connected to the third bearing, the third bearing being disposed between the first stationary bearing and the second bearing, the third bearing having a third axis that is parallel to the first axis and the second axis whereby movement of the guide roller in a direction perpendicular the plane of the transport path results in movement of the printing head in the said direction perpendicular to the plane transport path but to a lesser degree, the printing head also being mounted to the first guide rod, the first guide rod extends perpendicular to the transport path, the printing head being movable along the guide rod in a lateral direction away from the transport path.

2. The printing device of claim 1 further comprising a second lever, the second lever connected to the printing head and to the first, second and third bearings on an opposing side of the printing head and on an opposing side of the transport path.

3. The printing device of claim 1 wherein the third bearing comprises a second guide rod that extends through the printing head.

4. The printing device of claim 2 wherein the third bearing comprises a second guide rod that extends through the printing head.

5. The printing device of claim 4 wherein the printing head is mounted on the first guide rod so that it can rotate about the third axis and the first guide rod is fixedly connected to the first and second levers.

6. The printing head of claim 1 further comprises a third lever, a second guide roller and a fourth bearing, the third lever being connected to the second guide roller by the fourth bearing having a fourth axis that is parallel to the first axis, the first and third levers being connected by a push rod.

7. The printing device of claim 6 further comprising a paper stop, a fifth bearing, a pivoting lever and an actuation roller, the paper stop being pivotally connected to the third lever at the fifth bearing, the paper stop also engaging the pivoting lever, the pivoting lever being mounted about a sixth axis and further engaging actuation roller, the printing head engaging the actuation roller which imparts movement to the pivoting lever which imparts movement to the paper stop when the printing head is moved laterally away from the transport path resulting in movement of at least a portion of the paper stop into the transport path.

8. A printing device for transporting a piece of paper in a transport direction and along a predetermined transport path that defines a plane, the printing device comprising:

a printing head, a guide rod, a pivoting lever and a paper stop, the printing head disposed parallel to the transport path, the printing head being mounted to the guide rod that extends perpendicular to the transport path, the printing head being movable along the guide rod in a lateral direction away from the transport path, the printing head engaging the pivoting lever when the printing head is moved along the guide rod and laterally away from the transport path, the pivoting lever engaging the paper stop when the printing head is moved along the guide rod and laterally away from the transport path resulting in movement of at least a portion of the paper stop into the transport path.

9. The printing device of claim 8 wherein the paper stop comprises a paper stop lever having a stop surface, the paper stop lever being rotated about an axis that is parallel to the plane of the transport path and perpendicular to the transport direction, the pivoting lever has an axis of rotation that is disposed perpendicular to the transport path, the axis of rotation of the pivoting lever dividing the pivoting lever into a long section which engages the paper stop and a short section which is moved as a result of the lateral movement of the printing head away from the transport path.

10. The printing device of claim 9 wherein the printing head engages the actuation, the actuation roller engaging the short section of the pivoting lever and imparting pivotal movement to the pivoting lever when the printing head is moved laterally away from the transport path.

11. A printing device for transporting a piece of paper in a transport direction and along a predetermined transport path that defines a plane, the printing device comprising:

a printing head, a first lever, a first stationary bearing, a second bearing, a third bearing, a guide roller, a first guide rod, a pivoting lever and a paper stop, the printing head connected to the first lever, the first lever and printing head being connected to the first stationary bearing for pivotal movement about the first stationary bearing, the first stationary bearing having a first axis that is parallel to the plane of the transport path and perpendicular to the transport direction, the first lever also being connected to the guide roller by the second bearing having a second axis that is parallel to the first axis, the first lever further being connected to the third bearing, the third bearing being disposed between the first stationary bearing and the second bearing, the third bearing having a third axis that is parallel to the first axis and the second axis whereby movement of the guide roller in a direction perpendicular the plane of the transport path resulting in movement of the printing head in the said direction perpendicular to the plane transport path but to a lesser degree, the printing head also being mounted to the first guide rod that extends perpendicular to the transport path, the printing head being slidable along the first guide rod in a lateral direction away from the transport path, the printing head engaging the pivoting lever when the printing head is moved along the first guide rod and laterally away from the transport path, the pivoting lever engaging the paper stop when the printing head is moved along the first guide rod and laterally away from the transport path resulting in movement of at least a portion of the paper stop into the transport path.

12. The printing device of claim 11 further comprising a second lever, the second lever connected to the printing head and to the first, second and third bearings on an opposing side of the printing head and on an opposing side of the transport path.

13. The printing device of claim 12 wherein the third bearing comprises a second guide rod that extends through the printing head.

14. The printing device of claim 13 wherein the printing head is mounted on the second guide rod so that it can rotate about the third axis and the guide rod is fixedly connected to the first and second levers.

15. The printing head of claim 14 further comprising a third lever, a second guide roller, a fourth bearing and a push rod, the third lever being connected to the second guide roller by the fourth bearing having a fourth axis that is parallel to the first axis, the first and second levers being connected by the push rod.

16. The printing device of claim 15 wherein the paper stop comprises a paper stop lever having a stop surface, the paper stop lever being rotated about an axis that is parallel to the plane of the transport path and perpendicular to the transport direction, the pivoting lever has an axis of rotation that is disposed perpendicular to the transport path, the axis of rotation of the pivoting lever dividing the pivoting lever into a long section which engages the paper stop and a short section which is moved as a result of the lateral movement of the printing head away from the transport path.

17. The printing device of claim 16 wherein the actuation roller engages the short section of the pivoting lever an imparting pivotal movement to the pivoting lever when the printing head is moved laterally away from the transport path.

* * * * *